United States Patent [19]

Borona

[11] 4,118,680

[45] Oct. 3, 1978

[54] CIRCUIT INTERRUPTER

[75] Inventor: Russell T. Borona, Bridgeport, Conn.

[73] Assignee: Westinghouse Electric Corp., Pittsburgh, Pa.

[21] Appl. No.: 766,476

[22] Filed: Feb. 7, 1977

[51] Int. Cl.[2] ..... H01H 9/00

[52] U.S. Cl. ..... 335/176; 200/286; 337/360

[58] Field of Search ..... 200/249, 251, 259, 256, 200/261, 286; 335/176, 191; 337/360

[56] References Cited

U.S. PATENT DOCUMENTS 3,797,007 3/1974 Salvati et al. ..... 335/176

*Primary Examiner*—George T. Hall

*Attorney, Agent, or Firm*—L. P. Johns

[57] ABSTRACT

A circuit interrupter characterized by an insulating housing containing a circuit interrupter mechanism, calibration means operatively connected to the mechanism for adjusting operation of the contacts, the housing having a hole aligned with the calibration means, and a plastic plug in the hole, whereby a tamper-proof circuit interrupter is provided.

2 Claims, 2 Drawing Figures

CIRCUIT INTERRUPTER

BACKGROUND OF THE INVENTION

1. Field of the Invention:

This invention relates to a circuit interrupter housing containing a plugged access hole for calibration means within the housing.

2. Description of the Prior Art:

Heretofore circuit breaker calibration means have been rendered untamperable by one of two methods: calibration prior to closing the housing and mounting of a screw (or similar means) within the housing in such a way so as to be able to fill the exposed adjusting member with a potting compound of suitable type after case closure and calibration. In the latter case, the potting compound also acts as a retainer to prevent movement of adjusting means which could cause change in calibration. In some cases the UL label has been used to cover the exposed portion of the adjusting means, since a specific requirement of the UL label is that attempted removal must result in destruction of the label.

SUMMARY OF THE INVENTION

It has been found in accordance with this invention that the foregoing disadvantage may be overcome by providing a circuit interrupter comprising an insulating housing, a circuit interrupter mechanism within the housing and comprising a pair of cantacts operable to open and close an electric circuit, calibration means operatively connected to the mechanism for adjusting operation of the contacts, the housing having an access hole aligned with the calibration means, a plug in the hole, the plug having a diameter slightly greater than that of the hole, whereby an inner end portion of the plug extends beyond the inner end of the hole and is expanded to its unrestrained diameter.

The advantage of the device of this invention is that tamper-proof plugging means are provided which requires actual removal of the housing once the initial calibration is made and the plug means installed. Further advantages of the plugging means include the ability of the housing to withstand high quantities of breaker gassing, and the relative ease of application of the plugging means.

DESCRIPTION OF THE PREFERRED EMBODIMENT

Figure 1:
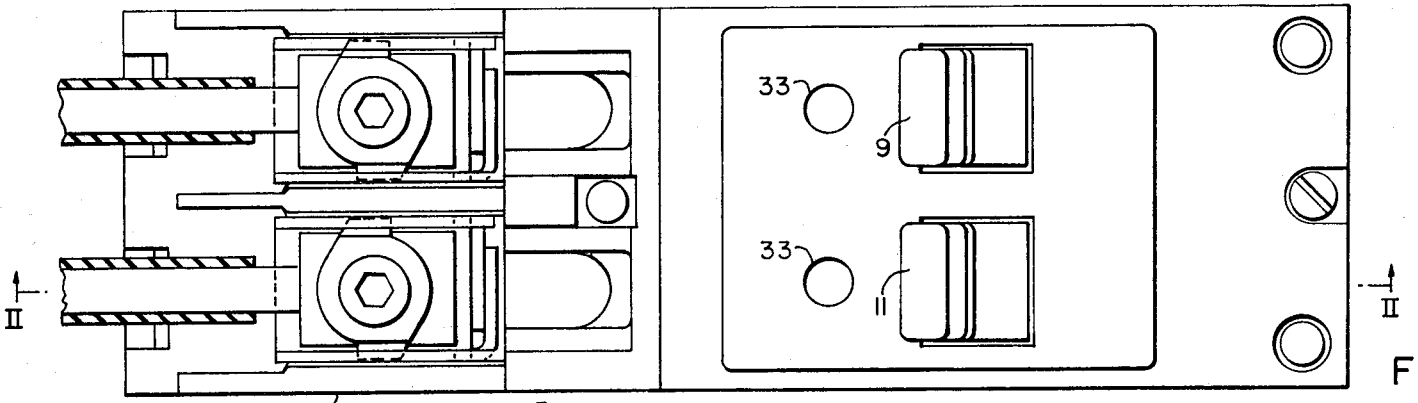
FIG. 1 is a plan view of the type of circuit breaker involved in this invention.

In the drawings a circuit interrupter or circuit breaker is generally indicated at 3 and it comprises an electrically insulating housing 5. Although the circuit interrupter disclosed is a two-pole type of circuit breaker, the device of this invention is not limited to that type of circuit breaker. Suffice it to say, a pair of handles 9, 11 (one for each pole) extends through the top of the housing 5. The handles are separately movable between two positions to open and close contacts, such as contacts 13 and 14 (FIG. 2) within the housing 5 in a manner well known in the art. The contact 14 is connected by a conductor 17 to a clip-type terminal 19 to which a conductor 21 is electrically connected. Like wise, the contact 13, being mounted on a contact arm

23, is connected by conductor means 25 to an external conductor 27 in a circuit includng the conductors 21, 27. Within the housing a trip device generally indicated at 29 serves to effect automatic opening of the circuit breaker contacts in response to predetermined overload conditions in the circuit of any pole unit of the circuit breaker. The trip device 29 comprises a calibration means, such as a calibrating screw 31, by which the trip device 29 may be calibrated for a given current rating. The circuit interrupter 3 may be a circuit breaker of the type described in U.S. Pat. No. 3,492,614, issued Jan. 27, 1970, to G. J. DeAngelo, and assigned to Westinghouse Electric Corporation in which a specific circuit breaker construction including a trip device is disclosed and incorporated as a part hereof.

Figure 2:
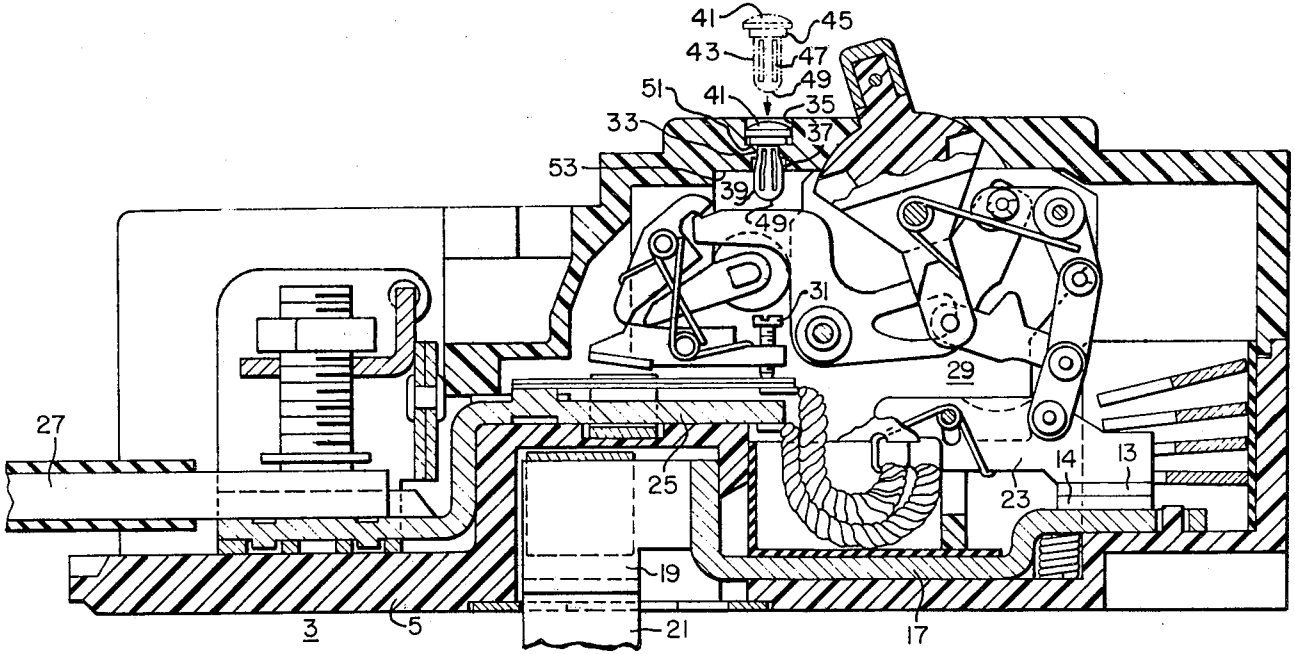
FIG. 2 is a side elevational view of the circuit breaker shown in FIG. 1.

As shown in FIGS. 1 and 2, an aperture or hole 33 is provided in the top portion of the housing 5, whereby access may be had to the setscrew 31. The hole 33 includes upper and lower counterbores 35, 37 so that the intermediate portion of the hole is of reduced diameter compared to those of the counterbores.

In accordance with this invention, the hole 33 is aligned with the setscrew 31 to enable the calibration of the trip device 29 for a desired current rating. Thereafter, it is desirable to avoid subsequent adjustments of the setscrew 31 to recalibrate the trip device 29. For that reason, plugging means, or a plug, 39 is inserted into the hole 33 in such a way that it cannot be readily removed from outside of the housing 5. The plug 39 is a molded pop rivet comprising a plastic material, such as nylon 6. For example, a long-chain synthetic polymeric amide is suitable. The plug 33 includes a head 41 and an elongated body 43 which includes a should 45. The body 43 is preferably hollow and includes peripherally spaced slots 47 which communicate between the interior bore and the exterior of the plug. The lower end of the plug is closed at 49.

When the plug 39 is in place in the hole 33, the head 41 is completely contained within the upper counterbore 35 with the shoulder 45 on the bottom surface 51 of the counterbore and with the body 43 within the hole 33. The lower portion of the body 33 extends through the lower counterbore and below the inner surface 53 of the top of the housing 5. The diameter of the body 43 is slightly greater than the diameter of the hole 33 so that the plug 39 is within the intermediate portion of the hole 33 is compressed therein to the diameter of the intermediate portion. However, the lower portion of the body 43 extending below the intermediate portion of the hole 33 is free to expand to its unrestricted dimension. As a result, plug 39 is held securely in place. Compression of the body 43 is enabled by the spaced vertical slots 47. Accordingly, the plug 39 offers a tamper-proof means of sealing the calibration hole 33 as required by the Underwriter Laboratories.

In conclusion, usage of a plastic molded pop rivet or plug offers a unique means of plugging an external calibration hole of a circuit breaker. The plug is available at low cost and has a holding means which can tolerate high case pressures under short circuit fault conditions. Moreover, the plug offers a tamper-proof means of sealing the calibration hole.

What is claimed is:

1. A circuit interrupter comprising an insulating housing, a circuit interrupter mechanism within the housing and comprising a pair of contacts operable to open and close an electric circuit, calibration means operatively connected to the mechanism for adjusting operation of the contacts, the housing having a hole aligned with the calibration means, and a plug in the hole and having a diameter slightly greater than that of the hole, whereby an inner end portion of the plug extends beyond the inner end of the hole and is expanded to its unrestrained diameter.

2. The circuit interrupter of claim 1 in which the plug comprises a central bore and longitudinal slot means.

* * * * *